United States Patent [19]

Gründler

[11] 4,446,676

[45] May 8, 1984

[54] BAG HANDLING APPARATUS FOR A BAG MAKING MACHINE

[75] Inventor: Bruno Gründler, Neuhausen am Rheinfall, Switzerland

[73] Assignee: SIG-Schweizerische Industrie-Gesellschaft, Neuhausen am Rheinfall, Switzerland

[21] Appl. No.: 320,061

[22] Filed: Nov. 10, 1981

[30] Foreign Application Priority Data

Nov. 11, 1980 [CH] Switzerland ..... 8373/80

[51] Int. Cl.[3] ..... B31B 33/02

[52] U.S. Cl. ..... 53/552; 493/194; 493/252

[58] Field of Search ..... 53/552, 551, 550, 451, 53/175; 493/100, 197, 166, 180, 175, 194, 252; 198/487

[56] References Cited

U.S. PATENT DOCUMENTS 2,217,784 10/1940 Bennett et al. ..... 493/166 X
3,774,509 11/1973 Heinzer ..... 53/175 X
3,973,474 8/1976 Auckenthaler ..... 493/197
4,056,045 11/1977 Heinzer et al. ..... 493/100 X
4,076,115 2/1978 Daisley et al. ..... 198/487
4,215,520 8/1980 Heinzer et al. ..... 53/552 X

*Primary Examiner*—James F. Coan
*Attorney, Agent, or Firm*—Spencer & Frank

[57] ABSTRACT

A bag making machine includes a generally vertically oriented forming element on which bags are formed in succession; a conveyor extending underneath the forming element and having a generally horizontal direction of advance, a first drive for intermittently advancing the conveyor, bag grasping tongs supported underneath th forming element below the conveyor, a second drive for moving the tongs upwardly through the conveyor to the forming element and for moving the tongs downwardly from the forming element through the conveyor, whereby the tongs draw a bag off the forming element and deposit the bag on the conveyor. There is further provided a third drive for moving the tongs in a direction having a component parallel to the direction of advance of the conveyor. The second and third drives are synchronized with one another and with the first drive for moving the tongs simultaneously upwardly and in the direction of advance of the conveyor during motion thereof.

10 Claims, 6 Drawing Figures

BAG HANDLING APPARATUS FOR A BAG MAKING MACHINE

BACKGROUND OF THE INVENTION

This invention relates to an apparatus for withdrawing bags from a vertically oriented bag forming element of a bag making machine and positioning the bags in compartments of an intermittently advanced conveyor. The bags are formed from a web of indeterminate length and have longitudinal and transverse seams. The apparatus has periodically opening and closing tongs for grasping each bag at least at one bag fold. The tongs are coupled with a drive for advancing and then withdrawing the tongs through the respective compartment of the conveyor.

U.S. Pat. No. 4,215,520 discloses a machine which makes bags from a web of indeterminate length on a forming element by providing successive longitudinal and transverse seams of the foil material. The bags are filled with the intended contents either directly through a hollow mandrel or are first formed on a solid mandrel and then advanced to a filling station. In either instance the conveyor has to be moved intermittently as conditioned by the timed, stepwise bag making method. The pauses in the process are necessitated by the time periods required for making the transverse seam, for the filling of the bags and further, for grasping each bag by the tongs and depositing the bag in the compartment then aligned with the tongs. The compartments may be constituted, according to the abovenoted U.S. patent, by containers supported on a conveyor belt or they may be formed by a space defined directly by chain elements of the conveyor.

It will be readily appreciated that the components which have to travel the longest path are the tongs and it is therefore the displacement of the tongs which requires the greatest share of the pauses in the process. For this reason the elements associated with this operation have to be submitted to large accelerations (and decelerations) in order to maintain the pauses as short as possible.

SUMMARY OF THE INVENTION

It is an object of the invention to provide an improved apparatus of the above-outlined type in which the pauses are substantially shortened and in which lesser accelerations are needed for the tongs and the bags.

This object and others to become apparent as the specification progresses, are accomplished by the invention, according to which, briefly stated, in addition to the drive for imparting an advancing stroke and a return (working) stroke on the tongs, there is provided a further drive to move the tongs in a direction which has a component parallel to the feed direction of the conveyor. Stated differently, the further drive moves the tongs in a vertical plane defined by the direction of movement of the conveyor. Further, there are provided means for synchronizing the two drives with respect to one another and the drive of the conveyor in such a manner that the tongs may execute the advancing stroke during the stepwise shift of the compartments, whereas the conveyor is held stationary during the period the tongs execute their return stroke.

DESCRIPTION OF THE PREFERRED EMBODIMENTS

Figure 1:
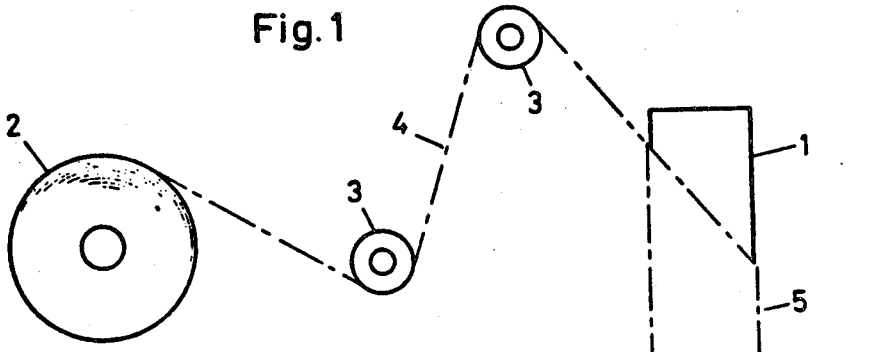
FIG. 1 is a schematic front elevational view of one part of the apparatus incorporating the invention.
Figure 2:
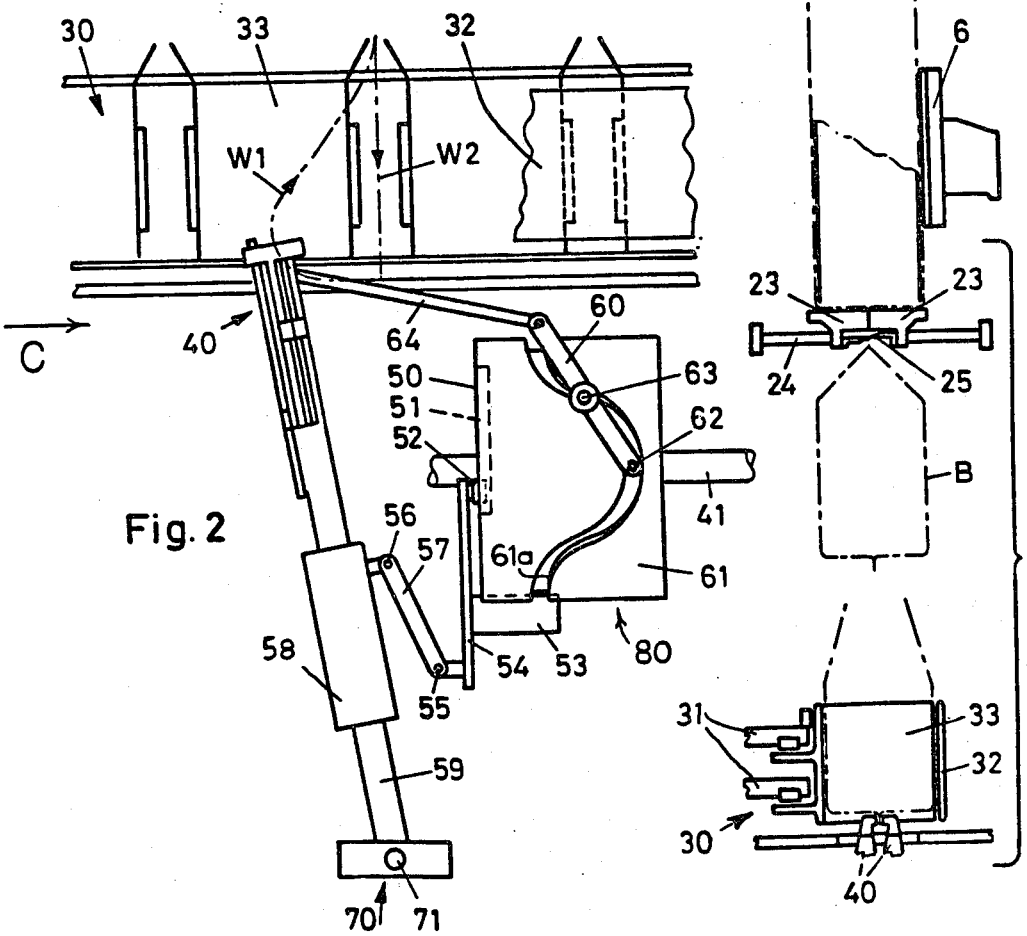
FIGS. 2 and 3 are schematic side elevational views of a preferred embodiment of the invention shown in two different operational positions.

Turning now to FIGS. 1 and 2, there is shown a stationary, vertically oriented forming tube 1 which preferably has a rectangular cross section and which, in a known manner, is surrounded by a fold making box (not shown for better visibility). A foil web 4 which is of a material that is, for example, heat-sealable, is drawn from a supply reel 2 over deflecting rollers 3 in a conventional manner between the forming tube 1 and the fold making box and is, as a result, folded about the folding tube 1 to constitute a hose 5 from which subsequently the individual bags are formed. The longitudinally still open hose 5 is sealed by a longitudinal sealing element 6 which may provide a fin seam or an overlapping seam. The transverse seam forming welding shoes 23 guided on stationary rails 24 and the severing knife 25 for cutting the bags B are shown only symbolically.

Underneath the above-described arrangement there is situated a conveyor generally indicated at 30 which has serially arranged bag carriers 33 as well as a chain guide 31 and a slide wall 32. With the conveyor 30 there are associated tongs 40 situated in a station where the bags are, in sequence, removed from the forming tube 1 and placed in the conveyor compartment then located in the station. Conveyor arrangements of this type are known and are disclosed, for example, in U.S. Pat. No. 4,056,045. It is noted that while in this U.S. patent dual tongs are disclosed, it is feasible to use simple tongs 40 as shown in FIG. 1. The tongs 40 serve for drawing downwardly each bag B and to position the bag in a bag carrier 33 of the conveyor.

The operating cycle of the conveyor 30 is determined by the operating cycle of the tongs 40 since the advance and stoppage of the conveyor and the motion of the tongs are interrelated.

According to the invention, the tongs 40, in addition to the advancing and return motions, execute a lateral motion in a vertical plane determined by the direction of motion C of the conveyor 30. In this manner the tongs 40 can, during movement of the conveyor 30, execute a lifting motion, for example, an upwardly directed forward motion (that is, a motion which has a component parallel to the feed direction C of the conveyor). Thus, the conveyor 30 has to be maintained stationary only during the period of the return motion of the tongs 40.

Since the mechanism for operating (opening and closing) the tongs is well known, the same need not be described and illustrated in detail.

Also turning now to FIGS. 3–6, the drive for displacing the tongs 40 comprises a cam drum generally indicated at 80. The cam drum 80 is mounted on, and thus rotated by, a shaft 41 which is the drive shaft for the conveyor 30 and which projects from the conveyor drive A.

The drive for vertically reciprocating the tongs 40 conventionally comprises a cam track 51 provided in a radial face 50 of the cam drum 80. Into the cam track 51 there extends a follower 52 which is supported at one end of a bell crank lever 54 pivotally held in a stationary bearing 53. The lever 54, at its end remote from the follower 52, is articulated at 55 to a link 57. The latter, in turn, is articulated at 56 to a carriage 58 supporting the tongs 40. The carriage 58 is axially slidably mounted on a guide rail 59.

To provide for a lateral displacement (excursion) of the tongs 40 according to the invention, in a cylindrical face 61 of the cam drum 80 there is provided a cam track 61*a* into which extends a follower 62 mounted on one end of a lever 60. The latter, at its mid-portion, is swingably supported in a stationary bearing 63. To that end of the lever 60 which is remote from the follower 62 there is articulated a coupling link 64, which, in turn, is articulated to an upper portion of the rail 59. The lower terminus of the rail 59 is swingably held by a pivot 71 in a support 70.

Figure 6:
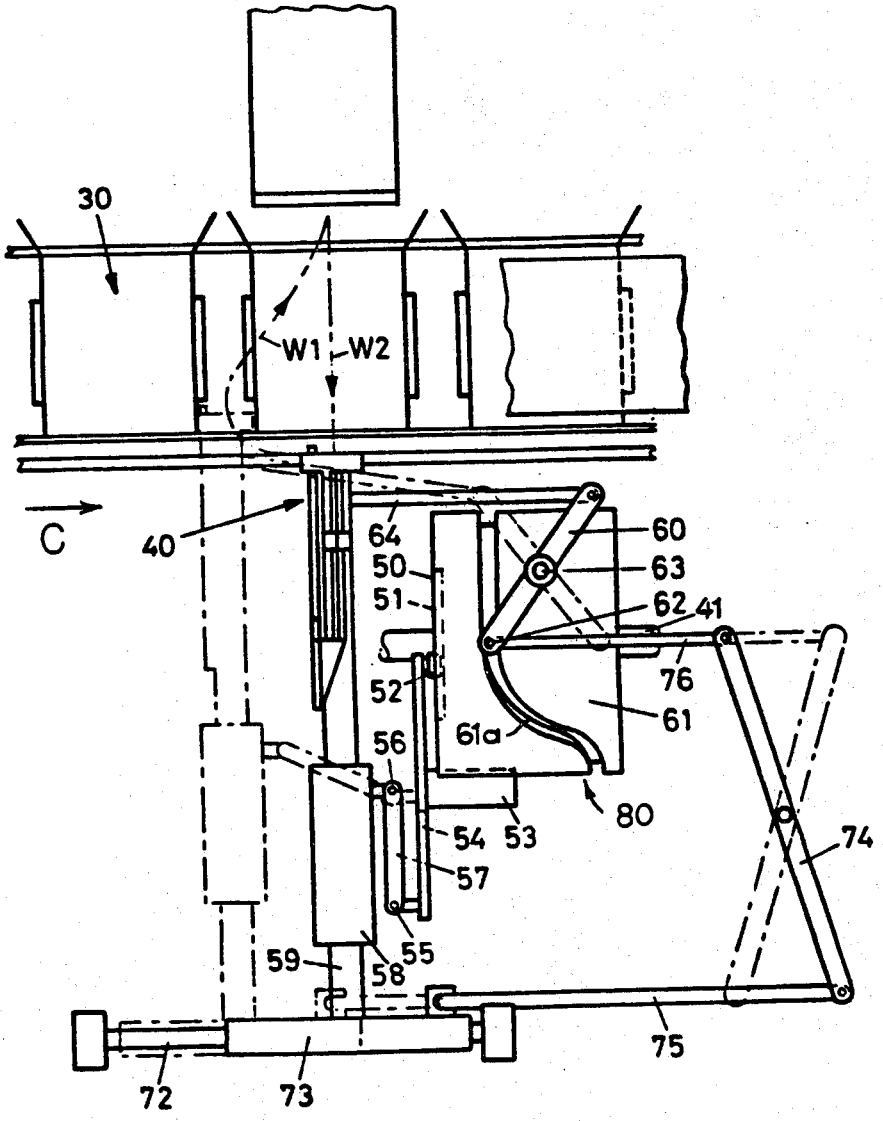
FIG. 6 is a schematic side elevational view similar to FIG. 2, illustrating another preferred embodiment of the invention.

Referring now in particular to FIG. 6, as an alternative for the lower support for the rail 59, there is provided a support rail 72 on which there is slidably mounted a sleeve 73 carrying the rail 59. While in the FIG. 2 embodiment the rail 59 executes an oscillating motion about the pivot 71, in the embodiment according to FIG. 6 the rail 59 is displaced transversely to its length, without changing its orientation. For this purpose, the sleeve 73 is driven by linkages 74, 75 and 76 coupled to the follower 62 which thus exerts the same forces to the sleeve 73 as the link 64 exerts to the upper end of the rail 59.

Figure 3:
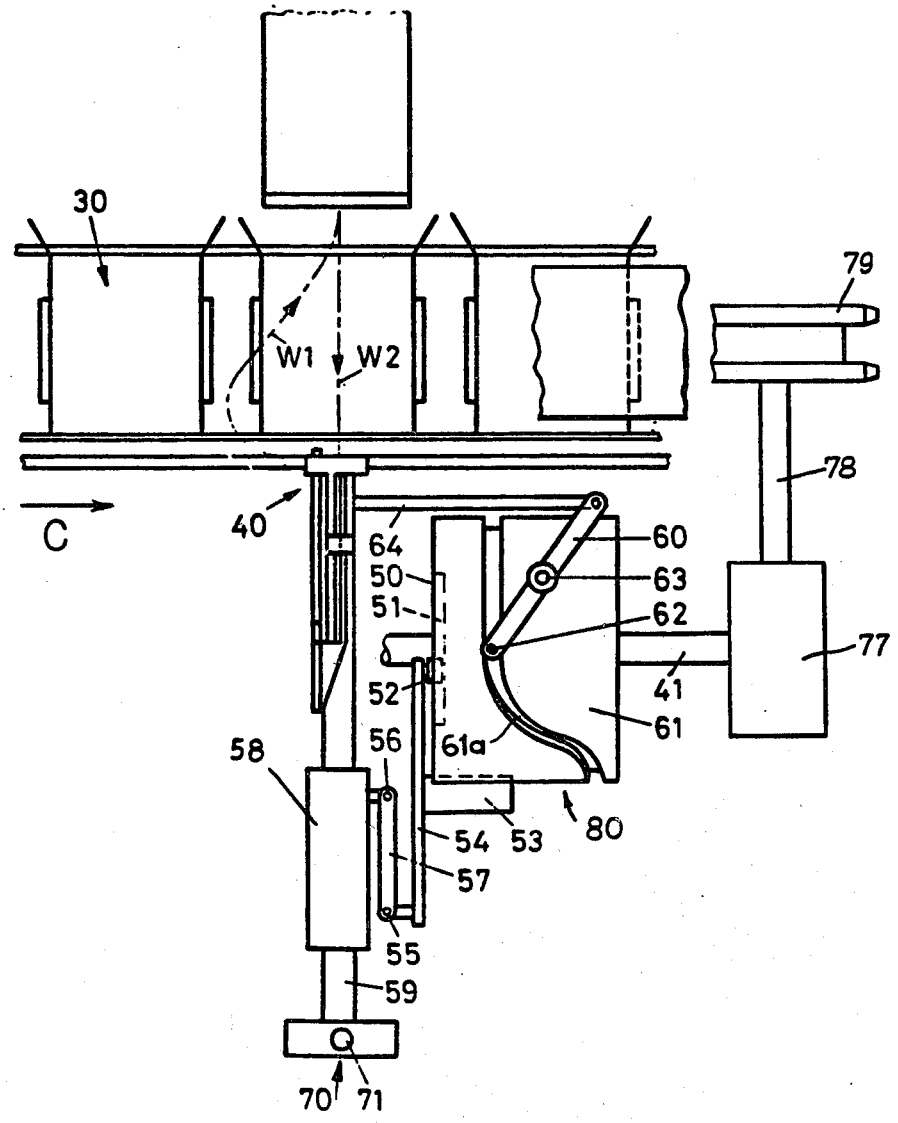

Turning in particular to FIG. 3, the continuously rotating shaft 41 intermittently drives the conveyor 30 in a conventional manner with the intermediary of a stepping gear 77, the stepping gear output shaft 78 and a sprocket 79 which is mounted on the shaft 78 and is connected to the conveyor 30. The stepping gear 77 comprises, for example, a conventional Geneva gear which provides for a synchronization of the motion between the tongs 40 and the compartments 33 of the conveyor 30. The tongs 40, from their position shown in, FIG. 3, move into their position shown in FIG. 2 while a new compartment 33 moves from a first position of rest one-half way toward the second position underneath the forming tube 1. Thereafter, the tongs 40 describe the paths W1 and W2 shown in dashed lines in FIGS. 2, 3 and 6. The tongs 40 execute their preparatory (advancing) stroke W1 synchronously with the motion of the conveyor, while the working stroke (return stroke) W2 is executed while the conveyor is at a standstill. It is thus seen that the advancing stroke has a motion component in the direction C of conveyor feed.

Figure 4:
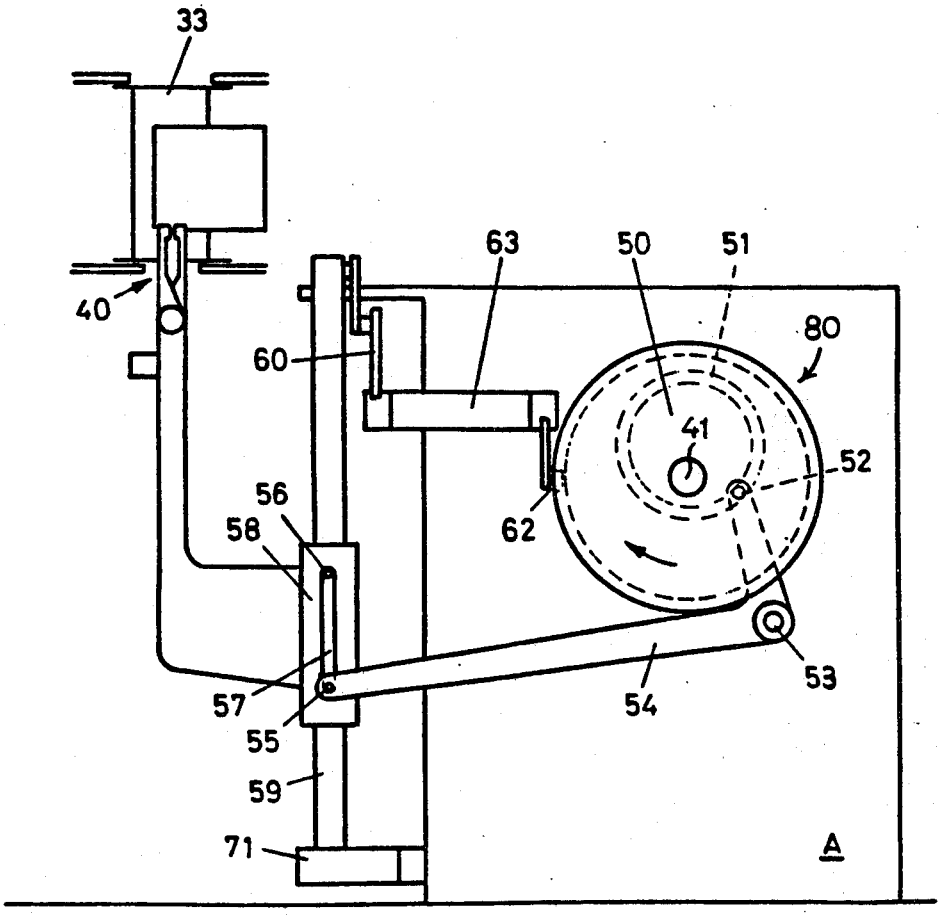
FIGS. 4 and 5 are schematic front elevational views of the preferred embodiment of the invention shown in the operational positions corresponding, respectively, to those shown in FIGS. 2 and 3.
Figure 5:
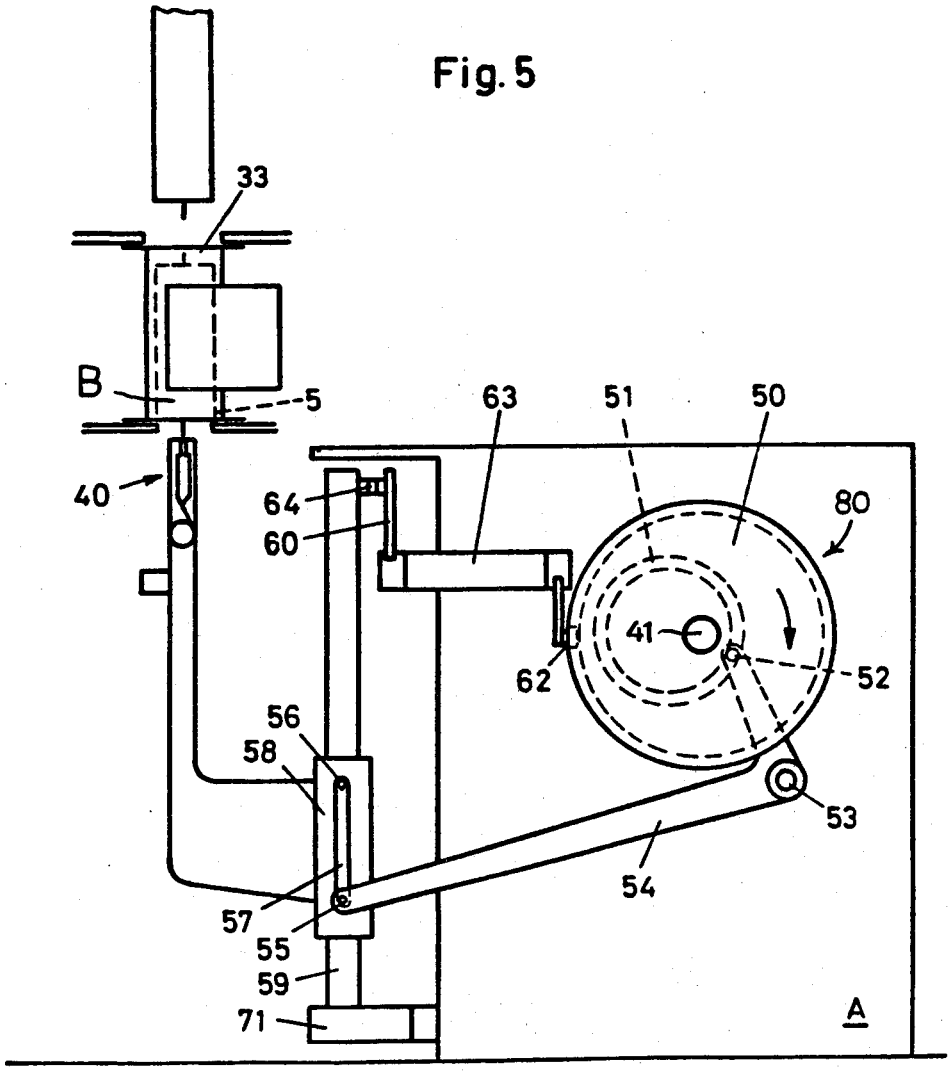

FIGS. 2 and 4 show the position of the tongs 40 at the beginning of the advancing stroke W1, while FIGS. 3 and 5 depict the moment at the end of the return stroke W2. At the conclusion of each return stroke (working stroke) W2 a bag B (FIG. 5) is deposited in a bag carrier 33 which at that time is in the operating range of the tongs 40. The curvilinear path W1 and the straight path W2 are the result of the synchronization of the two drives for the tongs 40, namely the drive for vertical reciprocation (cam track 51) and the drive for horizontal reciprocation (cam track 61*a*).

It is to be understood that instead of opening and closing tongs 40 it is feasible to use a suction gripper mounted on the guide rail 59.

By means of the above arrangement,the duration of the cycle for the conveyor is shortened while the bag grasping device may be moved in a more gentle cycle (that is, with smaller accelerations and decelerations).

It will be understood that the above description of the present invention is susceptible to various modifications, changes and adaptations, and the same are intended to be comprehended within the meaning and range of equivalents of the appended claims.

What is claimed is:

1. In a bag making machine including a generally vertically oriented forming element on which bags are formed in succession; a conveyor extending underneath said forming element and having a generally horizontal direction of advance, first drive means for intermittently advancing said conveyor, bag grasping tongs supported underneath said forming element below said conveyor, second drive means for moving said tongs upwardly through said conveyor to said forming element and for moving said tongs downwardly from said forming element through said conveyor, whereby said tongs draw a bag off said forming element and deposit the bag on said conveyor, the improvement comprising a third drive means for moving said tongs in a direction having a component parallel to said direction of advance of said conveyor and means for synchronizing said second and third drives with one another and with said first drive means for moving said tongs simultaneously upwardly and in said direction of advance during motion of said conveyor.

2. A bag making machine as defined in claim 1, wherein said means for synchronizing said second and third drives with one another and with said first drive means includes means for effecting a downward movement of said tongs while said conveyor is at a standstill.

3. A bag making machine as defined in claim 1, further comprising a guide rail having a lower part and an upper part, means for movably supporting said guide rail at said lower part and a carriage slidably mounted on said guide rail; said tongs being mounted on said carriage; said second and third drives being superposed on said tongs.

4. A bag making machine as defined in claim 3, wherein said means for movably supporting said guide rail at the lower part thereof comprises a pivotal support; said second drive means being connected to said carriage for moving said carriage on and with respect to said guide rail and said third drive means being connected to said guide rail for oscillating said guide rail about said pivotal support.

5. A bag making machine as defined in claim 3, wherein said means for movably supporting said guide rail at the lower part thereof comprises a sliding support having a stationarily held slide bar and a sleeve slidably mounted on said slide bar; said guide rail being affixed to said sleeve; said second drive being connected to said carriage for moving said carriage on and with respect to said guide rail and said third drive means being connected to said guide rail for reciprocating said guide rail on said slide bar.

6. A bag making machine as defined in claim 3, wherein said drive means is connected to said carriage for reciprocating said carriage on said guide rail and said third drive means is connected to said guide rail for moving said guide rail back and forth on said means for movably supporting said guide rail at the lower part thereof.

7. A bag making machine as defined in claim 6, wherein said second drive means comprises a first crank drive and said third drive means comprises a second crank drive.

8. A bag making machine as defined in claim 7, wherein said first crank drive comprises means defining a first cam track, a first follower engaging into said first cam track and a first linkage means connecting said first follower with said carriage; further wherein said second crank drive comprises means defining a second cam track, a second follower engaging into said second cam track and a second linkage means connecting said second follower with said guide rail.

9. A bag making machine as defined in claim 8, wherein said means defining said first cam track and said means defining said second cam track comprise a common cam drum carrying said first and second cam tracks; the positional relationship between said first and second cam tracks forming part of said means for synchronizing said second and third drives with one another.

10. A bag making machine as defined in claim 9, wherein said cam drum has a radial face carrying said first cam track and a lateral face carrying said second cam track.

* * * * *